US008617009B2

(12) United States Patent
Golom

(10) Patent No.: US 8,617,009 B2
(45) Date of Patent: Dec. 31, 2013

(54) BASEBALL SWING TRAINING DEVICE

(76) Inventor: Michael B. Golom, Hayward, WI (US)

( * ) Notice: Subject to any disclaimer, the term of this patent is extended or adjusted under 35 U.S.C. 154(b) by 18 days.

(21) Appl. No.: 12/914,972

(22) Filed: Oct. 28, 2010

(65) Prior Publication Data

US 2011/0098137 A1 Apr. 28, 2011

Related U.S. Application Data

(60) Provisional application No. 61/255,830, filed on Oct. 28, 2009.

(51) Int. Cl.
*A63B 69/00* (2006.01)

(52) U.S. Cl.
USPC ..... 473/452

(58) Field of Classification Search
USPC ..... 473/451–453, 218, 270–273, 278, 279
See application file for complete search history.

(56) References Cited

U.S. PATENT DOCUMENTS

| | | | | |
|---|---|---|---|---|
| 3,372,930 | A * | 3/1968 | Sertich | 473/452 |
| 4,516,772 | A * | 5/1985 | Stratton | 473/452 |
| 5,318,290 | A * | 6/1994 | Sawyer | 473/217 |
| 5,613,677 | A * | 3/1997 | Walker, Jr. | 473/452 |
| 6,926,625 | B1 * | 8/2005 | Fruechting | 473/452 |
| 7,335,117 | B2 * | 2/2008 | Reason-Kerkhoff | 473/452 |
| 8,075,426 | B1 * | 12/2011 | Griffin | 473/452 |
| 2008/0085788 | A1 * | 4/2008 | Rainer et al. | 473/452 |
| 2009/0233737 | A1 * | 9/2009 | Lerch | 473/452 |
| 2011/0092318 | A1 * | 4/2011 | Torch | 473/452 |

* cited by examiner

*Primary Examiner* — Mark Graham
(74) *Attorney, Agent, or Firm* — Richards Patent Law P.C.

(57) ABSTRACT

A baseball swing training device includes a rear foot pivot limiting mechanism, wherein the rear foot pivoting mechanism includes a rotating element and a rotation limiting element. The rear foot pivot limiting mechanism may be adapted to limit the rotation of a user's pivot foot to a prescribed degree of rotation and communicate to the user when the prescribed degree of rotation has been completed. The baseball swing device may further include a foldable base including two positions at which the adjustable rear foot pivot limiting mechanism may be implemented, wherein the first position is adapted for use by a right handed hitter and the second position is adapted for use by a left handed hitter.

9 Claims, 4 Drawing Sheets

BASEBALL SWING TRAINING DEVICE

CROSS-REFERENCE TO RELATED APPLICATIONS

This application incorporates by reference and claims priority to U.S. Provisional Patent Application No. 61/255,830 filed Oct. 28, 2009.

BACKGROUND OF THE INVENTION

The present subject matter relates generally to a baseball swing training device. More specifically, the present invention relates to a baseball swing training device for teaching back foot pivot technique.

In baseball, swing mechanics are the foundation of a player's skill set. A player may improve his or her game by consistently practicing proper swing mechanics. A training aid can improve a player's swing mechanics when the aid guides the player to practice consistently correct mechanics.

Swing mechanics are engrained into a player's muscle memory through repetition of the movements used during the swing. Accordingly, the more closely the training aid simulates or accommodates natural swing conditions, the more effective it may be building muscle memory.

The rear pivot foot is critical to the baseball swing. At the moment of impact in the swing, the rear foot braces the player against the force of the ball. When the rear foot is pivoted to a proper position, the player is able to impart a more forceful hit. Either under-pivoting or over-pivoting reduces the player's ability to impart his or her full strength into the ball.

Accordingly, a need exists for a baseball swing training device that teaches the user back foot pivot technique without interrupting the player's swing.

BRIEF SUMMARY OF THE INVENTION

The baseball swing training device disclosed herein encourages a player to pivot his or her rear foot to a desired selected position. A rotation-limiting mechanism including an adjustable positive stop prevents the user's rear foot from over-pivoting. The positive stop of the rotation-limiting mechanism encourages a player to continue pivoting until the positive stop is reached.

The baseball swing training device includes a platform upon which a user may take a batting stance. The platform acts as a stable base upon which an anchor may be mounted. A pivoting interface, such as, for example, a rotating panel, or flapper, may be attached to an anchor, or directly to the base, such that the pivoting interface rotates around an approximately vertical pivot. In operation, the user's rear foot engages the pivoting interface, whether by contact or by secured engagement. An adjustable positive stop is provided to limit the rotation of the pivoting interface and communicate or signal to the user that he or she has completed the rear foot pivot to the selected position.

The baseball swing training device may be arranged to accommodate both right handed and left handed swings. For example, the baseball swing training device may include a second pivoting interface such that the two pivoting interfaces may be arranged to accommodate both right handed and left handed batting stances on a single platform. Alternatively, a pivoting interface and rotation limiting mechanism may be adjustable to accommodate both right and left handed swings.

An advantage of the baseball swing training device is it teaches proper mechanics (encourages proper pivot) and prevents bad mechanics (prevents over pivoting) in a single device.

Another advantage of the baseball swing training device is it teaches proper swing footwork and balance.

A further advantage of the baseball swing training device is that it may easily be adapted to teach proper mechanics for both right and left handed swings, thus encouraging players to learn to switch hit. With the advantage of switch hitting, players will be developing both sides of their body equally, resulting in greater muscular/skeletal balance.

Yet another advantage of the baseball swing training device is it is easily adapted for indoor use, encouraging year round use.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
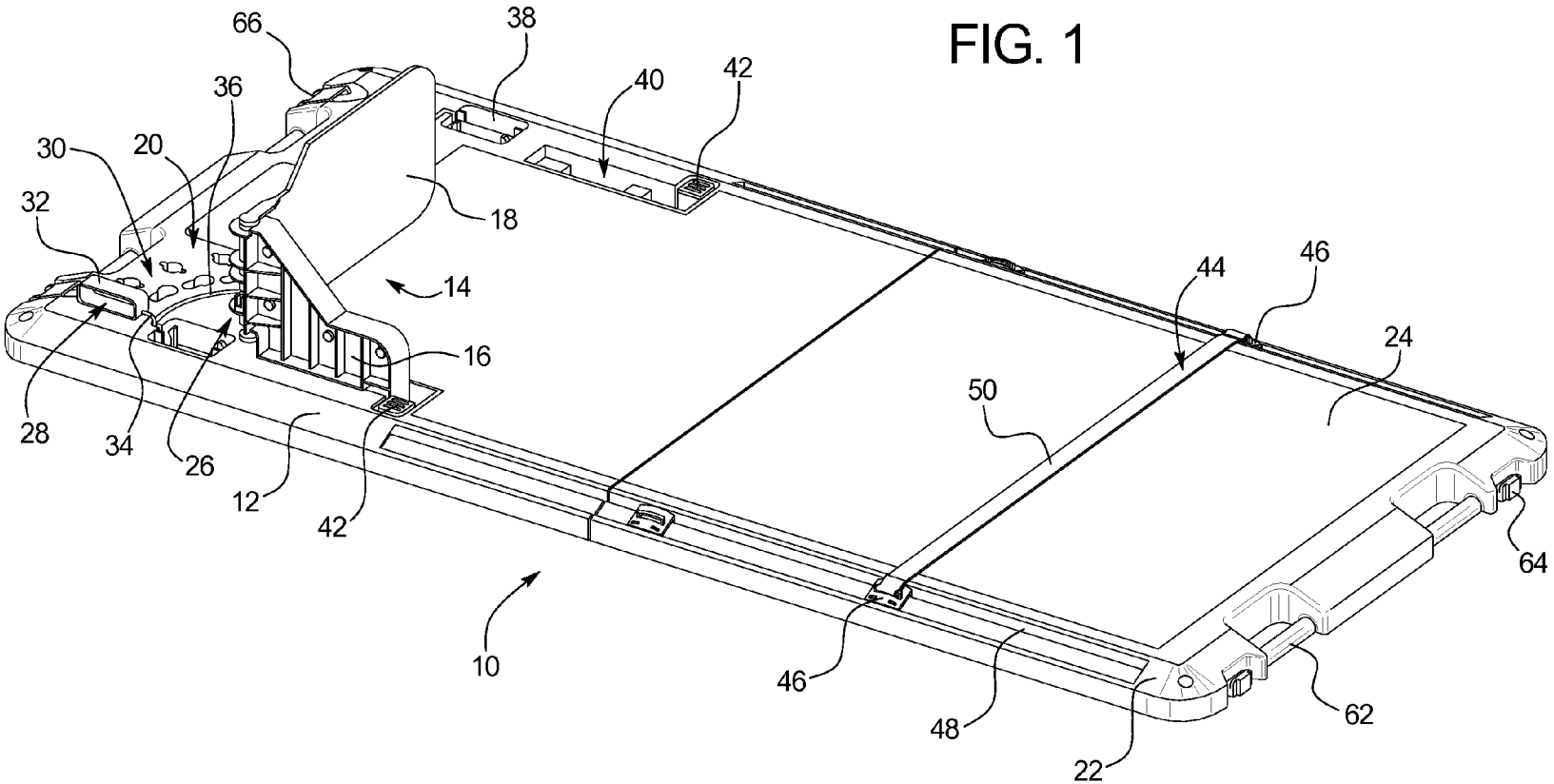
FIG. 1 is a perspective view of a baseball swing training device, wherein a rear foot pivot limiting mechanism is shown in a first position.

The baseball swing training device 10 shown in FIG. 1 includes a base 12 and a rear foot pivot limiting mechanism 14. Although the embodiment shown in FIG. 1 includes a single base 12 and a single rear foot pivot limiting mechanism 14, it is contemplated that a baseball swing training device 10 may alternately include, for example, a single base 12 and a pair of rear foot pivot limiting mechanisms 14. Alternately, it may be desirable to match any number of rear foot pivot limiting mechanisms 14 to a given base 12. For example, numerous players may be accommodated on a single base 12 having a plurality of appropriately spaced rear foot pivot limiting mechanisms 14.

In the example shown in FIG. 1, the rear foot pivot limiting mechanism 14 includes an anchor 16, a rotating element 18 attached via a rotation enabling mechanism 26 to the anchor 14 and a rotation limiting mechanism 20. As shown and described further herein, the rear foot pivot limiting mechanism 14 may be adapted and positioned to engage either a right handed batting stance or a left handed batting stance. Accordingly, the rear foot pivot limiting mechanism 14 shown in FIG. 1 has a rotation limiting mechanism 20 adapted to prevent over rotation in each given direction (counter-clockwise when adapted for a right handed stance and clockwise adapted for a left handed stance).

While a specific example of a rear foot pivot limiting mechanism 14 is illustrated in the Figs., it is understood that numerous embodiments of rear foot pivot limiting mechanisms 14 may be provided that include various rotating elements 18 and various rotation limiting mechanisms 20. For example, the rotating element 18 shown in the Figs. is a rotating panel 18, yet the rotating element 18 may take any form that enables the user's rear foot to interact with the rotation limiting mechanism 20.

In examples in which a single rear foot pivot limiting mechanism 14 is employed to engage both right and left handed batting stances, the rotation limiting mechanism 20 must be adaptable to limit rotation in both directions. In other envisioned embodiments, the baseball swing training device 10 may include dedicated left and right handed batting stance rear foot pivot limiting mechanisms 14.

In use, a batter may take a stance such that the front foot (the foot that would be closest to the pitcher) is located in an open section of the base 12, where it may be free to move as it would in the course of a baseball swing, and the rear foot (the foot that would be furthest from the pitcher) engages the rear foot pivot limiting mechanism 14 to assist in training the rear foot pivot mechanics of the user. In the initial position, the batter's rear foot is positioned to engage by contact the rotating element 18 in approximately the position shown in FIG. 1. As the batter swings, the rotating element 18 rotates with the batter's foot as it pivots to the hitting position. The rotation limiting mechanism 20 stops the rotation of the batter's rear foot when the batter's foot reaches the desired hitting position, for example as shown in FIG. 2.

In most case, the intended position for the rotation limiting mechanism 20 to stop rotation of the rotating element 18 is when the player has made a rear foot pivot of approximately 90 degrees. However, alternative batting techniques and the batter's physical mechanics may dictate that the rear foot and/or the rotating element 18 should rotate more or less than 90 degrees to reach the desired limiting point. Thus, the rotation limiting mechanism 20 shown is an adjustable rotation limiting mechanism 20, which is described in greater detail below.

Figure 2:
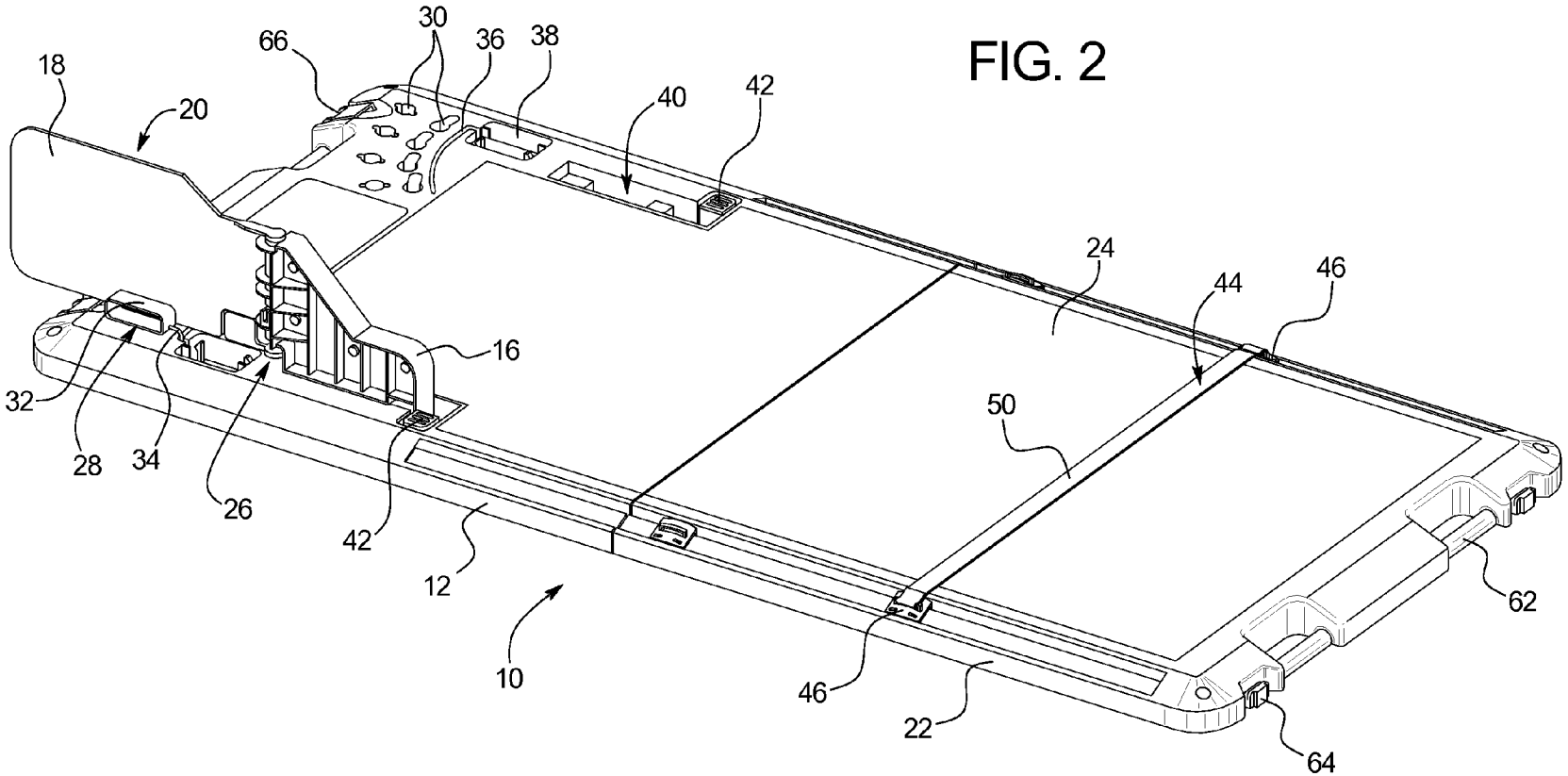
FIG. 2 is a perspective view of the baseball swing training device shown in FIG. 1, wherein the rear foot pivot limiting mechanism is shown in a second, rotation limited position.
Figure 4:
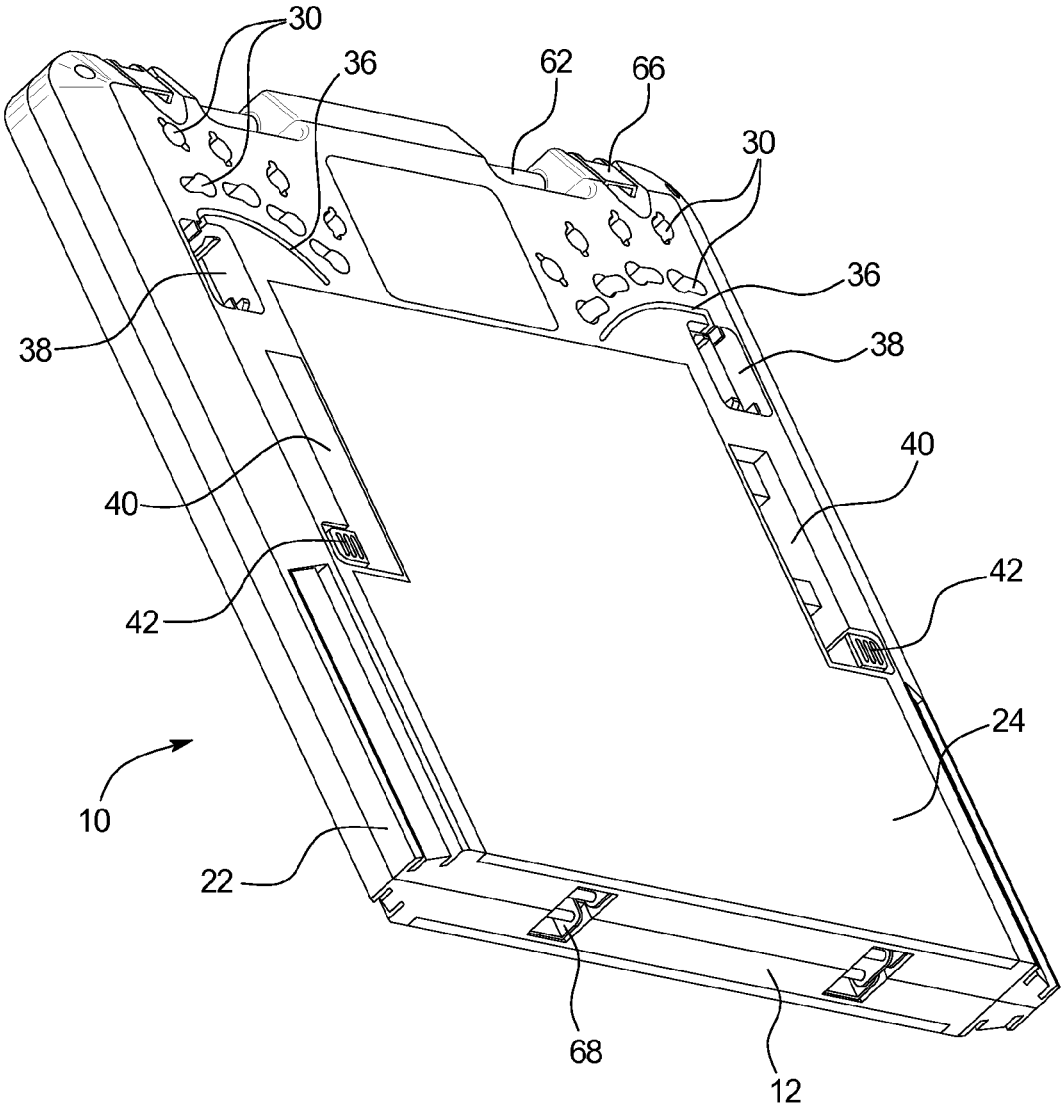
FIG. 4 is a perspective view of the baseball swing training device in carrying condition.

The example of the rotation limiting mechanism 20 shown in FIGS. 1, 2 and 4 includes a stopper 28 adaptable to be located in any of a plurality of stopper positions 30. In use, the stopper 30 provides a positive stop against which the rotating element 18 may come to rest after the desired rear foot pivot has been made by the user. Accordingly, the rotation limiting mechanism 20 is adapted to limit the rotation of a user's pivot foot to a prescribed degree of rotation and communicate to the user when the prescribed degree of rotation has been completed by providing a physical stop. It is contemplated that the rotation limiting mechanism 20 may further or alternatively include an audible alarm or other mechanism for communicating to the user when the appropriate rear foot pivot has been made.

As shown in the examples provided in FIGS. 1, 2 and 4, there are four stopper positions 30 for each of the left-handed and right-handed rotation limiting mechanisms 20. However, it is understood that any number of positions 30 may be used, including embodiments in which the stopper position 30 is infinitely adjustable within a given range. In use, the rotating element 18 makes forceful contact with the stopper 28. In order to reduce wear between the parts and reduce the volume of the impact the contact surfaces may be padded with rubber or similar materials.

In the specific example shown in FIGS. 1, 2 and 4, the stopper 28 includes a body 32 and a tail 34. The tail 34 slides within and along a slot 36 and the body 32 is adapted to lock into place in any one of the given stopper positions 30. In addition, a stopper storage space 38 is provided for holding the stopper 28 when not in use. In the example shown, the stopper 28 snaps and locks into place within the stopper storage space 38.

As further shown in FIGS. 1, 2 and 4, the anchor 16 may be secured to the base 12 to accommodate either a left-handed or right-handed batting position. The anchor 16 snaps and releasably locks into place in the base 12 in an anchor lock 40. The anchor 16 is released via an anchor lock release 42, which is shown in FIGS. 1, 2 and 4 as a release button 42. Accordingly, the anchor 16 shown in FIGS. 1, 2 and 4 may quickly be adapted for use with a right or left handed batting stance.

The base 12 shown in FIG. 1 includes a structural layer 22 formed from plastic with a synthetic turf layer 24 mounted thereto. The structural layer 22 may also includes feet attached to the bottom to assist in stabilizing the base 12 on the surface upon which it is intended to be used. It is contemplated that the base 12 may be a single layer or multiple layers, include feet or other securing mechanisms or not, and may be formed from any number of structural materials. For example, the base 12 may be formed from a hard plastic platform that is light, sturdy and foldable as shown in FIGS. 1, 2 and 4. In another example, the structural layer 22 of the base 12 may be constructed from plywood and may include metal feet designed to stabilize the base on grass, dirt or other surfaces into which the metal feet may dig. Further, the leading edge of the base 12 may be graded to resemble a ramp such that if a pitched ball were to hit the base 12, it would take a more predictable bounce than it would if it were to contact a sharp angle on the leading edge.

As further shown in FIGS. 1 and 2, the base 12 includes a stride guide 44, which may be used to provide a visual reference for the batter's front foot to stride to when swinging. The stride guide 44 shown in FIGS. 1 and 2 includes a pair of sliding clips 46 adapted to slide along rails 48 on either side of the base 12 and a band 50 crossing the top of the base 12 to provide the visual reference. The sliding clips 46 allow the stride guide 44 to be positioned at an appropriate location along the base 12 and are adjustable to accommodate various players' swings. It is contemplated that there are numerous manners in which the position adjustable stride guide 44 may be employed and it is recognized that the embodiment shown in merely one possible embodiment.

Figure 3:
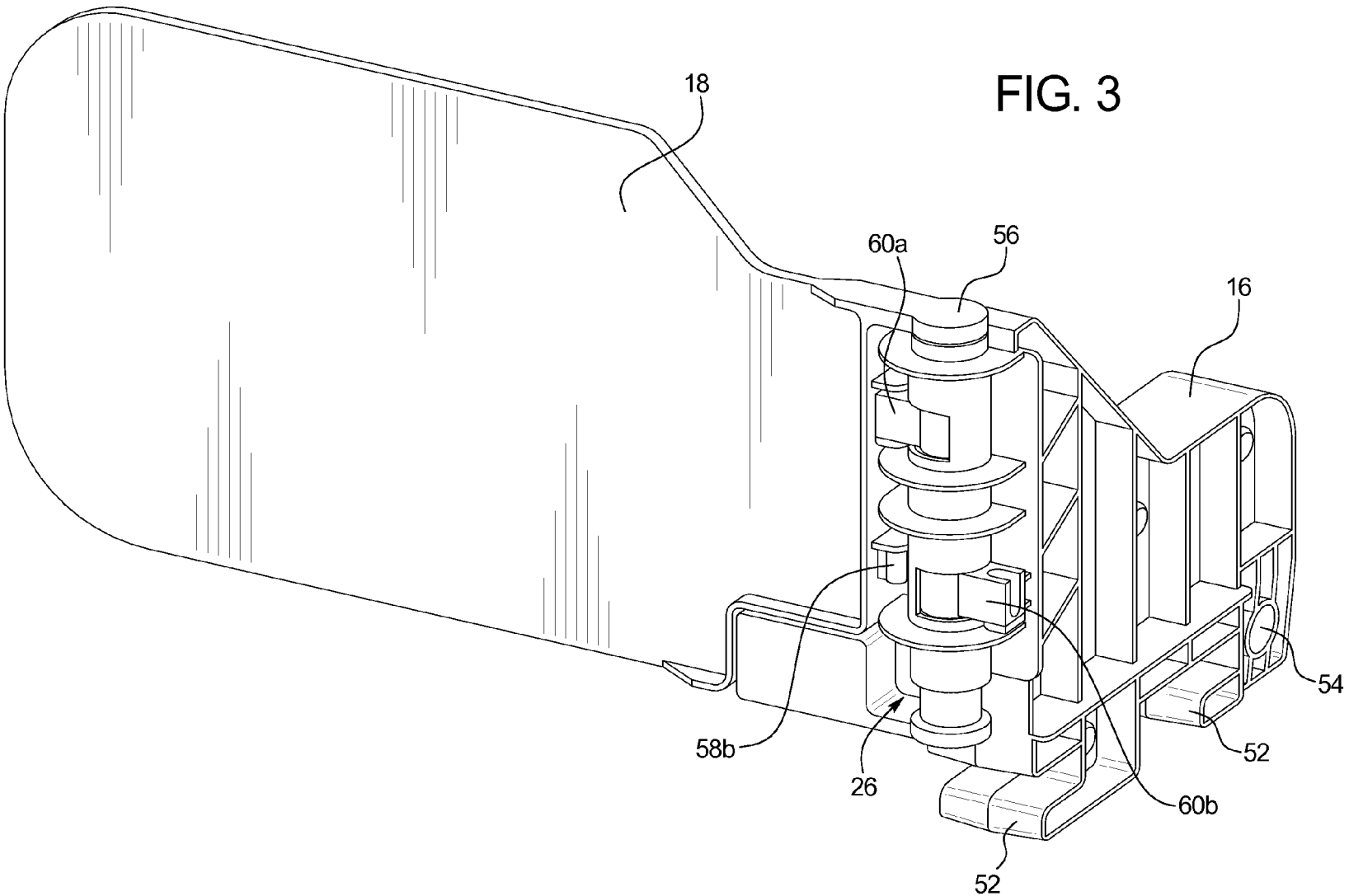
FIG. 3 is a perspective view of the adjustable pivoting mechanism of the baseball swing training device shown in FIG. 1.

Turning now to FIG. 3, one embodiment of the anchor 16, rotating element 18 and the rotation enabling mechanism 26 are illustrated. The anchor 16 shown in FIG. 3 includes a pair of hooks 52 adapted to lock into place in the anchor lock 40 and a receiving hole 54 adapted to cooperate with the release button 42 to secure the anchor 16 in place. It is contemplated that other mechanisms may be employed to secure the anchor 16 in place within the anchor lock 42.

As further shown in FIG. 3, the rotating element 18 includes an axial mount 56 and a pair of pins 58. The axial mount 56 rotatably attaches to the anchor 16 and provides a pivot reference axis about which the rotating element 18 may rotate. Each of the pins 58 is adapted to cooperate with an associated receiving slot 60 on the anchor 16. There is an upper pin **58*a* (not shown, hidden within the upper receiving slot 60*a*) and a lower pin 58*b* and an associated upper receiving slot 60*a* and a lower receiving slot 60*b*. When the rotating element 18 is attached to the anchor 16 to be adapted for use with a right handed swing, the upper pin 58*a* is located within the upper receiving slot 60*a*, as shown in FIG. 3. Alternatively, when the rotating element 18 is attached to the anchor 16 to be adapted for use with a left handed swing, the lower pin 58*b* is located within the lower receiving slot 60*b*. In these alternate configurations, the rotating element 18 may rotate between different angles of rotation specifically adapted for right and left handed swings, respectively. Accordingly, the rotating element 18** may be quickly adapted to be configured for either left or right handed swings.

A torsion spring (not shown) may be provided within the anchor 16 and connected to the receiving slots 60 to bias the rotating element 18 into the appropriate position and a force against which the user's rear foot pivot must overcome.

Turning now to FIG. 4, the baseball swing training device 10 is shown in a folded configuration. As shown in FIG. 4, the baseball swing training device 10 includes handles 62 and a catch 64 and latch 66 mechanism for keeping the baseball swing training device 10 in a closed and locked configuration. As further shown, the baseball swing training device 10 includes a pair of hinges 68 that enable the base 12 to be folded as shown. Other folding and locking mechanism may be employed in various embodiments of the baseball swing training device 10.

It is contemplated that the baseball swing training device 10 may include storage space (not shown) located along the bottom of the base 12 such that elements of the baseball swing training device 10, such as, for example, the anchor 16 and rotating element 18, may be stored within the baseball swing training device 10 when folded for storage or transportation.

Although shown in FIGS. 1-4 as a specific embodiment, it is contemplated that there are numerous embodiments that may be used to accomplish the advantages of the subject matter provided herein. For example, it is contemplated that in an alternative embodiment, the anchor 16 may be a wooden block bolted to the base 12 to provide a stable structure to which a rotating element 18 may be attached. In another example, a metal rod may be installed vertically through the base 12 such that the rod is stable and provides an axis around which a rotating element 18 may rotate.

In such an alternative embodiment, the rotating element 18 may be a wooden panel attached to the anchor 16 via a rotation enabling mechanism 26, such as a hinge. The hinge may be, for example, a tension adjustable four inch spring hinge. The wooden panel may be sized to engage a batter's foot and provide enough structural size, mass and rigidity to prevent over-rotation of the batter's foot. It is understood that the hinge is just one example of a rotation enabling mechanism 26 and that other mechanisms may be employed in the baseball swing training device 10.

In an alternative embodiment, the stopper 28 may be a small pvc pipe that fits into one of a plurality of holes functioning as stopper positions 30 in the base 12. As described above with respect to FIG. 3, the holes 30 may be positioned to enable various degrees of rotation. For example: when the stopper 28 is placed in a first hole 30, the rotating element 18 may rotate approximately 80 degrees from its starting point; when the stopper 28 is placed in a second hole 30, the rotating element 18 may rotate approximately 90 degrees from its starting point; and when the stopper 28 is placed in a third hole 30, the rotating element 18 may rotate approximately 100 degrees from its starting point. While the example shown includes a finite number of stopper positions, it is contemplated that other rotation limiting mechanisms 20 may be infinitely adjustable within a given range. For example, a slot may be provided in the base 12 through which a stopper 28 may be positioned and locked (for example using a secure clamping mechanism) into any of an infinite number of positions along the slot, wherein the slot angle relative to the rotation of the rotating element 18 enables adjustment of the degree of rotation allowed.

In the embodiments in which two or more rear foot pivot limiting mechanisms 14 are mounted to the base 12, the unused rotating element 18 may be safely positioned out of the way of the others. For example, in an embodiment in which a pair of rotating element 18 is used to accommodate either left or right handed swings, the rotating element 18 for left handed swings may be rotated past the holes 30 and then the stopper 28 may be positioned to hold the rotating panel on the opposite side of the stopper 28.

It is contemplated that various changes to the structure and geometry may be made to improve the performance of the baseball swing training device 10. For example, in another embodiment of the baseball swing training device 10, two metal straps may be provided between the anchor 16 and the rotating element 18 to tension the rotation of the rotating element 18, thereby providing some resistance against the pivoting rear foot. Similarly, the metal straps may function as the rotation limiting mechanism 20.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A baseball swing training device comprising:

a rear foot pivot limiting mechanism adapted to limit the rotation of a user's pivot foot to a prescribed degree of rotation, wherein the rear foot pivoting mechanism includes a rotating element and a rotation limiting element; and a base including a surface onto which the rear foot pivot limiting mechanism is mounted, the base including a top surface that is horizontally planar, wherein the rotating element is a rotating panel having a height, length, and thickness, with the thickness being measured parallel to the top surface of the base, wherein each of the height and the length are greater than the thickness, wherein, in use, the user's foot pivots on the top surface and in direct contact with the top surface such that the rotating element is not located between the user's foot and the top surface, wherein the rotating element pivots around a stationary anchor fixed to the base, wherein the anchor is repositionable to a plurality of anchor receiving positions on the base, further wherein, when the anchor is fixed to a first anchor receiving position on the base, the rear foot pivoting mechanism is adapted for a right handed stance and, when the anchor is fixed to a second anchor receiving position on the base, the rear foot pivoting mechanism is adapted for a left handed stance.

2. The baseball swing training device of claim 1 wherein the rotation limiting element is an adjustable stopper.

3. The baseball swing training device of claim 2 wherein the adjustable stopper is adapted to be positioned in any of a plurality of locations.

4. The baseball swing training device of claim 2 wherein the adjustable stopper is adapted for infinite adjustment within a range of positions.

5. The baseball swing training device of claim 1 wherein the rear foot pivot limiting mechanism may be adapted for use with right and left handed swings.

6. The baseball swing training device of claim 1 wherein the base is foldable.

7. The baseball swing training device of claim 6 wherein the base includes one or more latches and catches for securing the base in a folded position.

8. The baseball swing training device of claim 1 wherein the plurality of positions onto which the rear foot pivot limiting mechanism may be mounted include a quick release locking mechanism for locking the rear foot pivot limiting mechanism in place.

9. The baseball swing training device of claim 1 further comprising a stride guide.

* * * * *